United States Patent [19]

Hirano

[11] Patent Number: 4,601,264

[45] Date of Patent: Jul. 22, 1986

[54] COOLING SYSTEM FOR AUTOMOTIVE ENGINE

[75] Inventor: Yoshinori Hirano, Yokohama, Japan

[73] Assignee: Nissan Motor Co., Ltd., Yokohama City, Japan

[21] Appl. No.: 734,696

[22] Filed: May 16, 1985

[30] Foreign Application Priority Data

May 18, 1984 [JP] Japan ..... 59-100156

[51] Int. Cl.[4] ..... F01P 3/22

[52] U.S. Cl. ..... 123/41.27; 123/41.44; 123/41.49

[58] Field of Search ..... 123/41.02, 41.08, 41.2–41.27, 123/41.44, 41.49

[56] References Cited

U.S. PATENT DOCUMENTS 1,687,679 10/1928 Mallory ..... 123/41.27

1,787,562 1/1931 Barlow ..... 123/41.44

4,367,699 1/1983 Evans ..... 123/41.23

4,425,766 1/1984 Claypole ..... 123/41.12

4,553,505 11/1985 Hirano et al. ..... 123/41.2

*Primary Examiner*—William A. Cuchlinski, Jr.

*Attorney, Agent, or Firm*—Schwartz, Jeffery, Schwaab, Mack, Blumenthal & Evans

[57] ABSTRACT

In order control the boiling point of the coolant in an engine wherein the coolant is boiled and the vapor used as a vehicle for removing heat, (a) the amount of liquid coolant retained in a radiator in which the vapor is condensed to its liquid form, is controlled to determine the radiator surface area available for the vapor to release its latent heat and (b) the cooling assistance provided by a fan is regulated. With this arrangement course temperature control is provided by controlling the amount of coolant in the radiator while finer control is provided by controlling the fan.

11 Claims, 16 Drawing Figures

SYSTEM CONTROL ROUTINE

SHUT-DOWN CONTROL ROUTINE

NON-CONDENSIBLE MATTER PURGE ROUTINE

COOLANT DISPLACEMENT - WARM-UP ROUTINE

NORMAL CONTROL ROUTINE

SHUT-DOWN CONTROL ROUTINE

COOLING SYSTEM FOR AUTOMOTIVE ENGINE

BACKGROUND OF THE INVENTION

1. Field of the Invention

The present invention relates generally to a cooling system for an internal combustion engine wherein liquid coolant is boiled to make use of the latent heat of vaporization of the same and the vapor used as a vehicle for removing heat from the engine, and more specifically to such a system which includes a control arrangement which enables the temperature of the coolant to be maintained within desired limits irrespective of ambient conditions such as the atmospheric air temperature and the like, under all modes of operation.

2. Description of the Prior Art

In currently used "water cooled" internal combustion engines such as shown in FIG. 1 of the drawings, the engine coolant (liquid) is forcefully circulated by a water pump, through a circuit includng the engine coolant jacket and an air cooled radiator. This type of system encounters the drawback that a large volume of water must be circulated between the radiator and the coolant jacket in order to remove the required amount of heat. Further, due to the large mass of water inherently required, the warm-up characteristics of the engine are undesirably sluggish. For example, if the temperature difference between the inlet and discharge ports of the coolant jacket is 4 degrees, the amount of heat which 1K g of water may effectively remove from the engine under such conditions is 4 Kcal. Accordingly, in the case of an engine having 1800 cc displacement (by way of example) is operated at full throttle, the cooling system is required to remove approximately 4000K cal/h. In order to achieve this a flow rate of 167 Liter/min (viz., $4000-60\times\frac{1}{4}$) must be produced by the water pump. This of course undesirably consumes a number of otherwise useful horsepower.

FIG. 2 shows an arrangement disclosed in Japanese Patent Application Second Provisional Publication No. Sho 57-57608. This arrangement has attempted to vaporize a liquid coolant and use the gaseous form thereof as a vehicle for removing heat from the engine. In this system the radiator 1 and the coolant jacket 2 are in constant and free communication via conduits 3, 4 whereby the coolant which condenses in the radiator 1 is returned to the coolant jacket 2 little by little under the influence of gravity.

This arrangement has suffered from the drawbacks that the radiator, depending on its position with respect to the engine proper tends to be at least partially filled with liquid coolant. This greatly reduces the surface area via which the gaseous coolant (for example steam) can effectively release its latent heat of vaporization and accordingly condense and thus has lacked any notable improvement in cooling efficiency.

Further, with this system in order to maintain the pressure within the coolant jacket and radiator at atmospheric level, a gas permeable water shedding filter 5 is arranged as shown, to permit the entry of air into and out of the system. However, this filter permits gaseous coolant to gradually escape from the system, inducing the need for frequent topping up of the coolant level.

A further problem with this arrangement has come in that some of the air, which is sucked into the cooling system as the engine cools, tends to dissolve in the water, whereby upon start up of the engine, the dissolved air tends to form small bubbles in the radiator which adhere to the walls thereof forming an insulating layer. The undissolved air tends to collect in the upper section of the radiator and inhibit the convection-like circulation of the vapor from the cylinder block to the radiator. This of course further deteriorates the performance of the device.

European Patent Application Provisional Publication No. 0 059 423 published on Sept. 8, 1982 discloses another arrangement wherein, liquid coolant in the coolant jacket of the engine, is not circulated therein and permitted to absorb heat to the point of boiling. The gaseous coolant thus generated is adiabatically compressed in a compressor so as to raise the temperature and pressure thereof and introduced into a heat exchanger. After condensing, the coolant is temporarily stored in a reservoir and recycled back into the coolant jacket via a flow control valve.

This arrangement has suffered from the drawback in that air tends to leak into the system upon cooling thereof. This air tends to be forced by the compressor along with the gaseous coolant into the radiator. Due to the difference in specific gravity, the air tends to rise in the hot environment while the coolant which has condensed moves downwardly. The air, due to this inherent tendency to rise, forms large bubbles of air which cause a kind of "embolism" in the radiator and badly impair the heat exchange ability thereof.

U.S. Pat. No. 4,367,699 issued on Jan. 11, 1983 in the name of Evans (see FIG. 3 of the drawings) discloses an engine system wherein the coolant is boiled and the vapor used to remove heat from the engine. This arrangement features a separation tank 6 wherein gaseous and liquid coolant are initially separated. The liquid coolant is fed back to the cylinder block 7 under the influence of gravity while the "dry" gaseous coolant (steam for example) is condensed in a fan cooled radiator 8. The temperature of the radiator is controlled by selective energizations of the fan 9 to maintain a rate of condensation therein sufficient to sustain a liquid seal at the bottom of the device. Condensate discharged from the radiator via the above mentioned liquid seal is collected in a small reservoir-like arrangement 10 and pumped back up to the separation tank via a small pump 11.

This arrangement, while providing an arrangement via which air can be initially purged from the system tends to, due to the nature of the arrangement which permits said initial non-condensible matter to be forced out of the system, suffers from rapid loss of coolant when operated at relatively high altitudes. Further, once the engine cools air is relatively freely admitted back into the system. The provision of the separation tank 6 also renders engine layout difficult.

Japanese Patent Application First Provisional Publication No. Sho. 56-32026 (see FIg. 4 of the drawings) discloses an arrangement wherein the structure defining the cylinder head and cylinder liners are covered in a porous layer of ceramic material 12 and liquid coolant sprayed into the cylinder block from shower-like arrangements 13 located above the cylinder heads 14. The interior of the coolant jacket defined within the engine proper is essentially filled with gaseous coolant during engine operation during which liquid coolant sprayed onto the ceramic layers 12. However, this arrangement has proven totally unsatisfactory in that upon boiling of the liquid coolant absorbed into the ceramic layers the vapor thus produced escaping into the coolant jacket inhibits the penetration of liquid coolant into the layers whereby rapid overheat and thermal damage of the ceramic layers 12 and/or engine soon results. Further, this arrangement is plagued with air contamination and blockages in the radiator similar to the compressor equipped arrangement discussed above.

U.S. Pat. No. 1,787,562 issued on Jan. 6, 1931 in the name of Barlow, teaches a vapor cooled type engine arrangement wherein a level sensor is disposed in the coolant jacket of the engine and arranged to control the operation of a coolant return pump. This pump is disposed in a small reservoir located at the bottom of the radiator or condensor in which the coolant vapor is condensed. A valve is arranged to vent the reservoir with the ambient atmosphere and thus maintain the interior of the radiator and coolant jacket at ambient atmospheric pressure under all operating conditions.

This arrangement suffers from the drawbacks that the valve is located in a position which is too low to enable all of the air to be purged out of the system when the engine is started, and that desirable variation in the coolant boiling point with changes in engine load is not possible. Viz., due to the tendency for the air to rise, some air is always present even when the engine is warmed up and running and due to the maintainance of atmospheric pressure in the system boiling point reduction/elevation is not possible.

Further, with the above mentioned arrangements an additional drawback is encountered in that the radiators or condensors of the same tend to cooled to a relatively large extent by the natural draft of air which passes thereof during motion of the vehicle and to a much lesser extent by the draft of air produced by the cooling fan arrangements thereof, it tends to be very difficult to control the temperature at which the engine coolant boils to a desired level when the vehicle is operated in extremely hot (e.g. desert) and extremely cold (e.g. arctic and/or snow clad mountainous areas) climates and/or zones.

In summary, although the basic concepts of open and closed "vapor cooling" systems wherein the coolant is boiled to make use of the latent heat of evaporation thereof and condensed in a suitable heat exchanger, is known, the lack of a control system which is both sufficiently simple as to allow practical use and which overcomes the various problems plauging the prior art is still wanting.

SUMMARY OF THE INVENTION

It is an object of the present invention to provide a vapor cooled engine which prevents contaminating air from entering same and which is capable of maintaining the temperature of the coolant at a desired value irrespective of various ambient conditions which tend to have a marked effect on the rate of heat exchange between the heat sink of the device and medium to which the heat is released.

In brief, the above objects are achieved by an arrangement wherein in order control the boiling point of the coolant, temperature control over a wide temperature range (viz., coarse control) is effected by varying the amount of liquid coolant retained in a radiator in which coolant vapor is condensed to its liquid form, and thus regulate the radiator surface area available for the vapor to release its latent heat, while fine temperature control is effected via utilizing the cooling assistance provided by a fan or like device.

In more specific terms a first aspect of the present invention comes in the form of an internal combustion engine having a structure subject to high heat flux, and a cooling system which comprises: a cooling circuit which includes (a) a coolant jacket formed about the structure subject to high heat flux and into which coolant is introduced in liquid form, permitted to boil and discharged in gaseous form, (b) a radiator exposed to a cooling medium which can remove heat from the radiator, (c) a vapor transfer conduit leading from the coolant jacket to the radiator for transfering gaseous coolant from the coolant jacket to the radiator for condensation therein, and (d) means for returning coolant condensed to its liquid state in the radiator to the coolant jacket in a manner to maintain the structure immersed in a predetermined depth of coolant; a first sensor for sensing a parameter which varies with the temperature of the coolant in the coolant jacket; a second sensor for sensing a parameter which varies with load on the engine; a reservoir containing liquid coolant; valve and conduit means for controlling fluid communication between the reservoir and the cooling circuit; a device for increasing the rate of heat exchange between the cooling medium and the radiator; and a control circuit responsive to the outputs of the first and second sensors for (a) controlling the valve and conduit means in a manner to control the amount of liquid coolant in the radiator and therefore the amount of surface area via which the latent heat of evaporation of the coolant vapour can be released, and (b) controlling the device in a manner to vary the rate of heat exchange between the radiator and the cooling medium.

A further aspect of the present invention comes in a method of controlling an internal combustion engine which comprises the steps of: introducing liquid coolant into a coolant jacket formed about structure of the engine subject to high heat flux; permitting the coolant to boil; condensing the gasesous coolant to its liquid form in a radiator exposed to a cooling medium; sensing a first parameter which varies with the temperature of the coolant in the coolant jacket; sensing a second parameter which varies with load on the engine; storing liquid coolant in a reservoir; controlling communication between the reservoir and the coolant jacket using valve and conduit means controlling the valve and conduit means in a manner to: (i) control the amount of liquid coolant in the radiator and thus the surface area thereof via which the latent heat of evaporation of the coolant can be released to the cooling medium; (ii) controlling a device associated with the radiator in a manner to vary the heat exchange between the radiator and the cooling medium.

BRIEF DESCRIPTION OF THE DRAWINGS

The features and advantages of the arrangement of the present invention will become more clearly appreciated from the following description taken in conjunction with the accompanying drawings in which.

DETAILED DESCRIPTION OF THE PREFERRED EMBODIMENTS

Before proceeding with the description of the actual embodiment of the present invention, it is deemed advantageous to firstly discuss some of the concepts on which the present invention is based.

Figure 1:
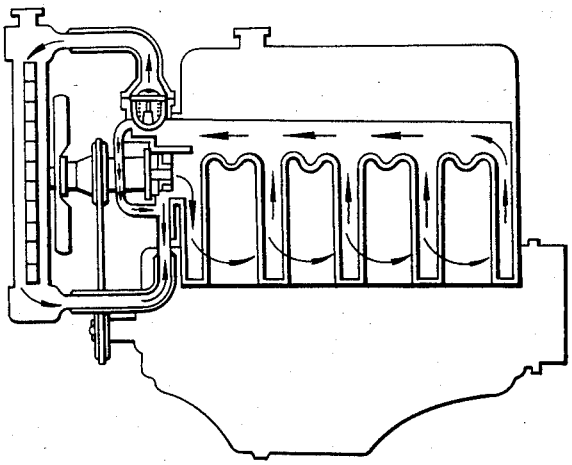
FIG.1 (PRIOR ART)
FIG. 1 is a partially sectioned elevation showing a currently used conventional water circulation type system discussed in the opening paragraphs of the instant disclosure.
Figure 2:
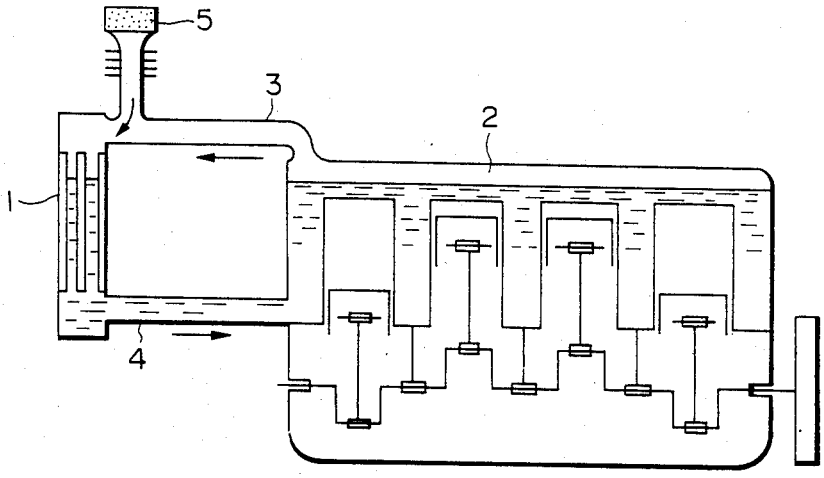
FIG.2 (PRIOR ART)
FIG. 2 is a schematic side sectional elevation of a prior art arrangement also discussed briefly in the earlier part of the specification.
Figure 3:
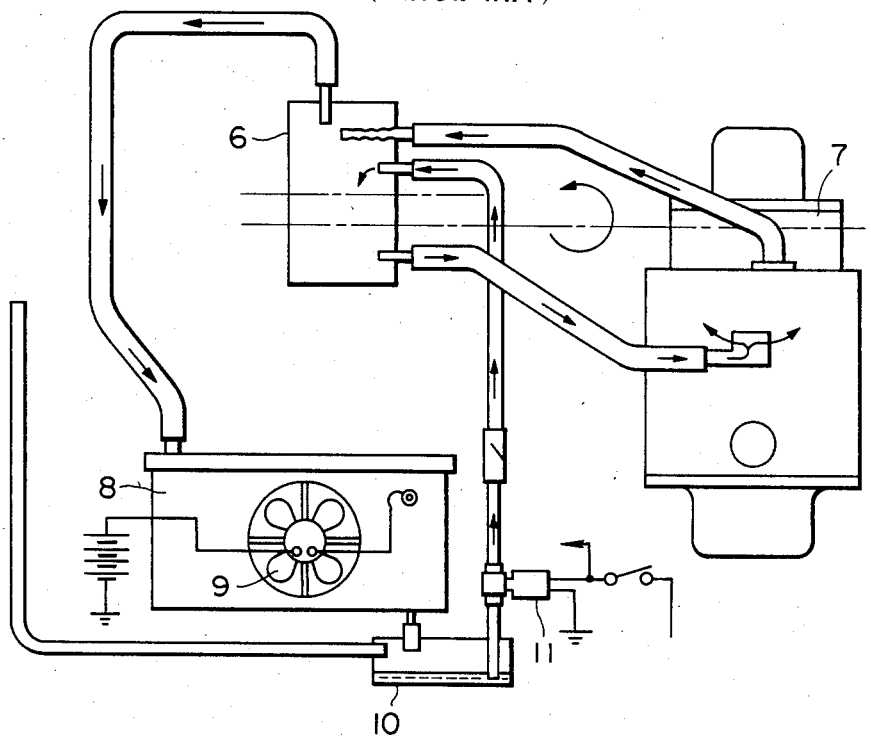
FIG. 3 (PRIOR ART)
FIG. 3 shows in schematic layout form, another of the prior art arrangements previously discussed.
Figure 4:
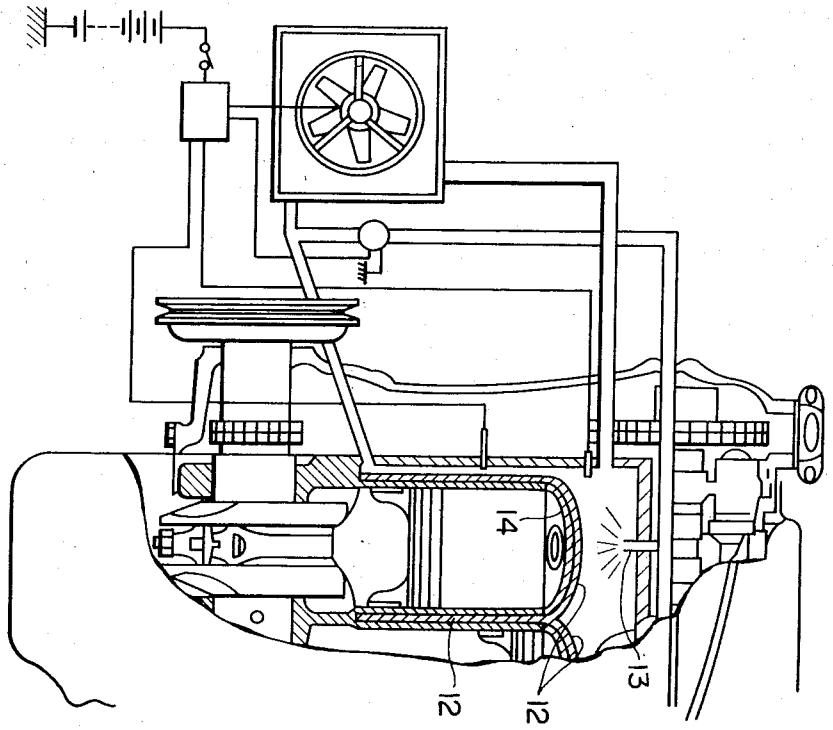
FIG.4 (PRIOR ART)
FIG. 4 shows in partial section yet another of the previously discussed prior art arrangements.
Figure 5:
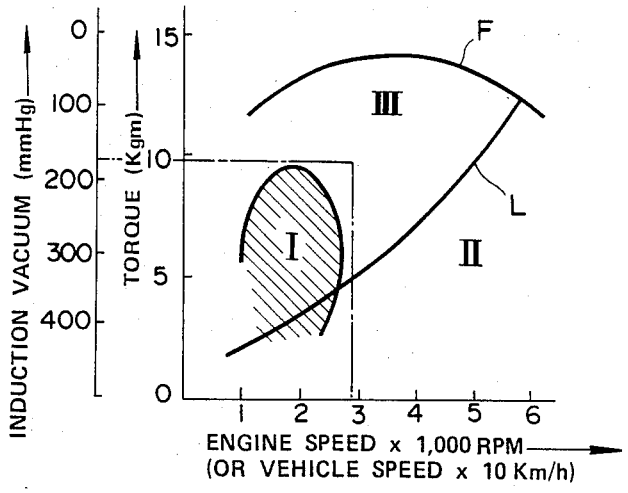
FIG. 5 is a graph showing, in terms of engine torque and engine/vehicle speed, the various load zones encounted by an automotive vehicle.
Figure 6:
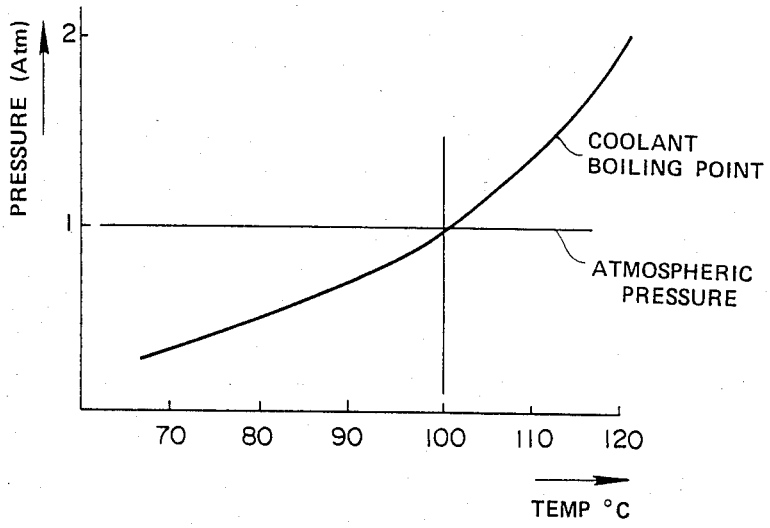
FIG. 6 is a graph showing, in terms of pressure and temperature, the change which occurs in the coolant boiling point with change in pressure.

FIG. 6 graphically shows, in terms of engine torque and engine speed, the various load "zones" which are encountered by an automotive vehicle engine. In this graph, the the curve F denotes full throttle torque characteristics, trace L denotes the resistance encountered when a vehicle is running on a level surface, and zones I, II and III denote respectively what shal be referred to as "urban cruising", "high speed cruising" and "high load operation" (such as hillclimbing, towing etc.,).

A suitable coolant temperature for zone I is approximately 110° C. while 100°-98° C. (for example) for zones II and III. The high temperature during "urban cruising" of course promotes improved fuel economy while the lower temperatures promote improved charging efficiency while simultaneously removing sufficient heat from the engine and associated structure to obviate enging knocking and/or engine damage in the other zones.

Figure 7:
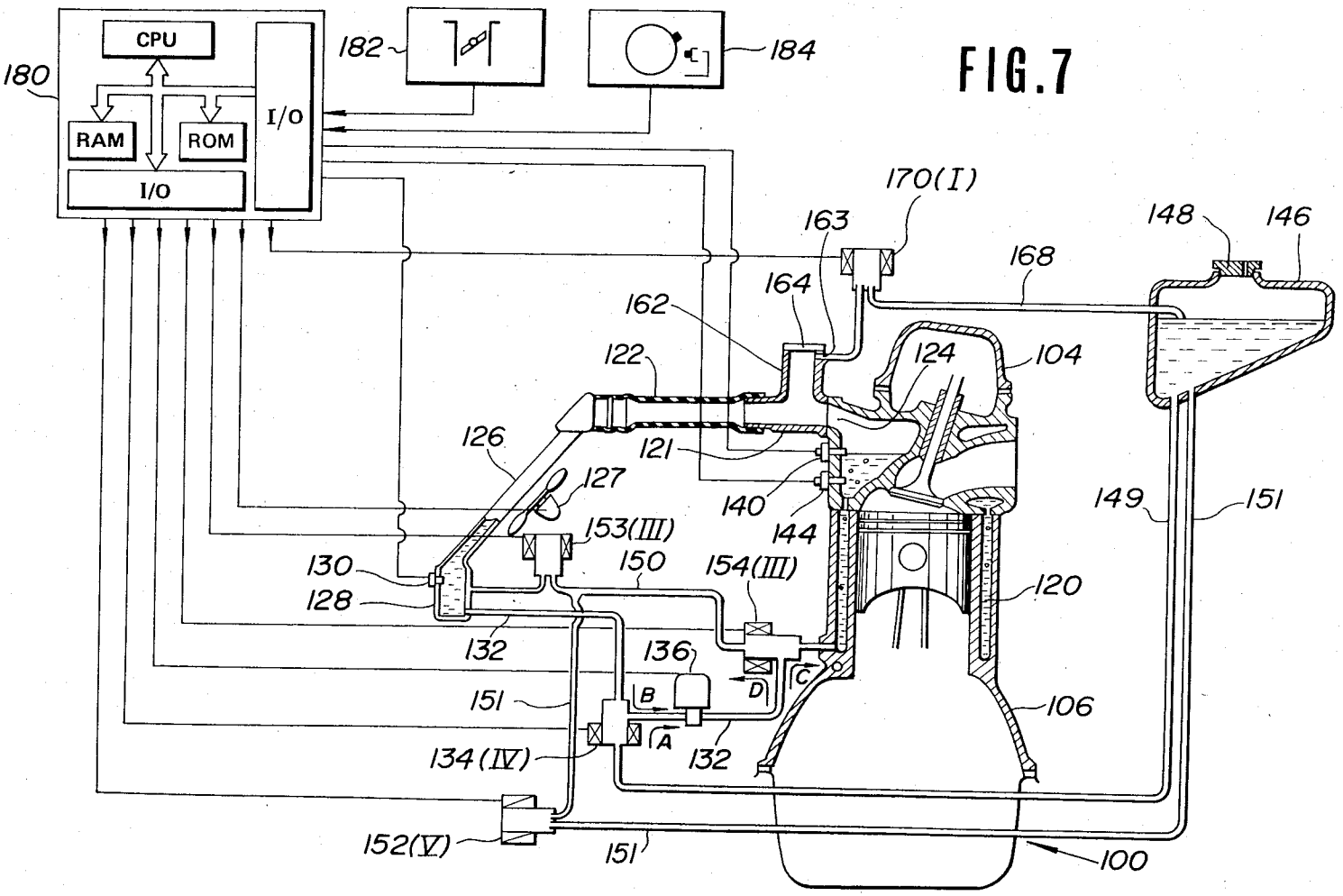
FIG. 7 is an elevation of a first embodiment of the present invention.

With the present invention, in order to control the temperature of the engine, advantage is taken of the fact that with a cooling system wherein the coolant is boiled and the vapor used a heat transfer medium, boiling is most vigorous in zones of high heat flux, whereby the temperature of engine structure subject to high heat flux is maintained essentially equal to that of structure subject to less intensive heating whereat boiling is less vigorous and less heat removed; the amount of coolant actually circulated between the coolant jacket and the radiator is very small; the amount of heat removed from the engine per unit volume of coolant is very high; and upon boiling, the pressure prevailing within the coolant jacket and consequently the boiling point of the coolant rises if the system employed is conditioned to assume a "closed" condition. Thus, by suitably arranging so that the rate of heat exchange between a cooling medium such as the ambient atmosphere (or the like) and the radiator is reduced to an appropriately low level, it is possible to quickly reduce the rate of condensation therein and cause the pressure within the cooling system to rapidly rise above atmospheric and thus induce the situation, as shown in FIG. 7, wherein the engine coolant boils at temperatures above 100° C.-for example at approximately 110° C.

On the other hand, during high speed cruising, by increasing the rate of heat exchange between the cooling medium and the radiator it is possible to quickly increase the rate of condensation within the radiator to a level which rapidly reduces the pressure prevailing in the cooling system to and/or below atmospheric and thus induces the situation wherein the coolant boils at temperatures at or below 100° C.

Figure 8:
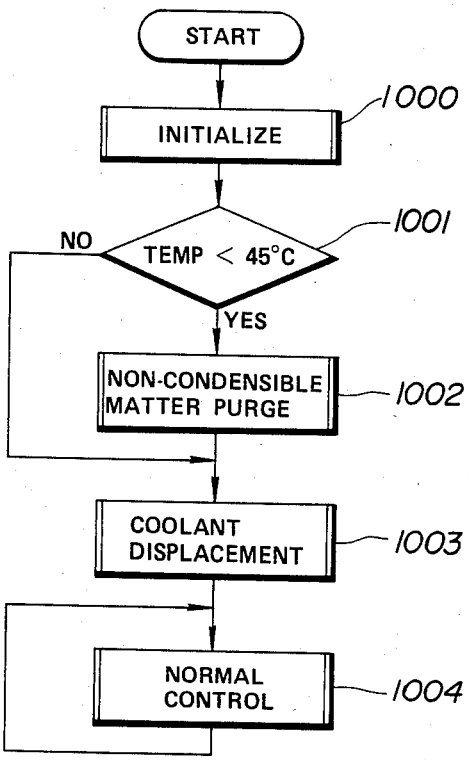
FIGS. 8 to 15 show flow charts which depict the various operations which characterize the operation of the first embodiment.

FIG. 8 shows an engine system incorporating a first embodiment of the present invention. In this arrangement, an internal combustion engine 100 includes a cylinder block 106 on which a cylinder head 104 is detachably secured. The cylinder head 104 and cylinder block 106 include suitable cavities which define a coolant jacket 120 about the heated portions of the cylinder head and block.

A vapor manifold 121 and vapor transfer conduit 122 provide fluid communication between a vapor outlet port 124 formed in the cylinder head 104 and a radiator or heat exchanger (viz., condensor) 126.

If deemed advantageous a mesh screen or like separator (not shown) can be disposed in the vapor discharge port 124 of the cylinder head so as to minimize the transfer of liquid coolant which tends to froth during boiling, to the radiator 126. Alternatively, cylinder head/manifold arrangements such as disclosed in U.S. Pat. No. 4,499,866 issued on Feb. 19, 1985 in the name of Hirano and U.S. patent application Ser. No. 624,369 filed in June 25, 1984 in the name of Hirano et al, now U.S. Pat. No. 4,553,505, can be employed if desired.

Located suitably adjacent the radiator 126 is a electrically driven fan 127. Defined at the bottom of the radiator 126 is a small collection reservoir or lower tank 128 as it will be referred to hereinafter. Disposed in the lower tank 128 is a level sensor 130 which is adapted to output a signal indicative of the level of liquid coolant in the lower tank 128 falling below same. Viz., being below a level selected to be lower than the lower ends of the tubing which constitute the heat exchanging portion of the radiator.

Leading from the lower tank 128 to the cylinder block 120 is a return conduit 132. As shown, a "three-way" type electromagnetic valve 134 and a relatively small capacity return pump 136 are disposed in this conduit. The valve 134 is located upstream of the pump 136. In this embodiment the return conduit 132 is arranged to communicate with the lowermost portion of the coolant jacket 120.

In order to sense the level of coolant in the coolant jacket and appropriately control the operation of the pump 136, a level sensor 40 is disposed as shown. It will be noted that this sensor is arranged at a level higher than that of the combustion chamber, exhaust ports and valves (structure subject to high heat flux) so as to ensure that they are securely immersed in coolant and thus attenuate any engine knocking and the like which might otherwise occur due to the formation of localized zones of abnormally high temperature or "hot spots".

Located below the level sensor 140 so as to be immersed in the liquid coolant is a temperature sensor 144. It will of course be appreciated that this sensor may alternatively be located a level above that at which the liquid coolant is maintained during engine operation if so desired.

A coolant reservoir 146 is located beside the engine proper as shown. In this embodiment the reservoir 146 is advantageously disposed at a relatively high position with respect to the engine so that a gravity feed effect is obtained. It should be noted however, that if the engine layout so demands, the reservoir can be located in positions other than the illustrated one and that the present invention is not limited to same (see FIG. 16 by way of example).

An air permeable cap 148 is used to close the reservoir 146 in a manner that atmospheric pressure continuously prevails therein.

The reservoir 146 fluidly communicates with the "three-way" valve 134 via a supply conduit 149 and with what shall be termed a "level control conduit" 150 via a displacement/discharge conduit 151. In this embodiment the three-way valve 134 is arranged to establish flow path A (viz., connect the pump with reservoir 146 when energized (ON) and flow path B (connect the lower tank 128 with pump 136) when de-energized (OFF).

As shown an ON/OFF type electromagnetic valve 152 is disposed in conduit 151. This valve is arranged to be closed to cut-off communication between the reservoir 146 and conduit 151 when energized. A second ON/OFF type electromagnetic valve 153 is disposed in conduit 150 between the lower tank 128 and the location where conduits 150 and 151 connect. This valve is arranged to be normally open (viz., closed when energized)

A second three way-way valve 154 is arranged to selectively communicate one of conduits 132 and 150 with the coolant jacket. In this instance the valve is arranged to provide flow path C when de-energized (OFF) and flow path D when energized.

The vapor manifold 121 includes a riser-like portion 162 in which a "purge" port 163 is formed. A cap 164 hermetically closes the riser 162. Port 163, as shown, communicates with the reservoir 164 via an overflow conduit 168. A normally closed electromagnetic valve 170 is disposed in the overflow conduit 168. This valve is opened when energized.

The above mentioned level sensors 130 & 140 may be of any suitable type such as float/reed switch types.

As shown, the outputs of the level sensors 130 & 140, temperature sensor 144 and pressure differential sensor 172 are fed to a control circuit 180. In this embodiment the control circuit 180 includes therein a microprocessor including input and output interfaces I/O a CPU, a RAM and a ROM. Suitable control programs are set in the ROM and are used to control the operation of the valves 134, 152 & 170, pump 136 and fan 127 in response to the various data supplied thereto.

In order to determine the temperature at which the coolant should be controlled to under the given set of operating conditions (in this instance engine load and speed) a load sensor 182 and an engine speed sensor 184 are arranged to supply data signals to control circuit 180. The load sensor may take the form of a throttle position switch which is triggered upon the engine throttle valve being opened beyond a predetermined degree; alternatively the output of an air flow meter of an induction vacuum sensor may be used. The engine speed signal may be derived from the engine distributor, a crankshaft rotational speed sensor or the like.

However, as pointed out above the system is very responsive to the rate of heat exchange between the ambient atmosphere and the radiator and as such tends to be overly responsive to the environmental conditions (air temperature, humidity wind strength etc.). As such it is normally very difficult to design a single radiator which is suited for use in both deserts and arctic conditions, as cooling fan 127 only acts to increase the heat exchange by supplementing the normal air flow and is usually a smally power economical arrangement.

Thus, a major feature of the present invention comes the control of the level of liquid coolant in the radiator 126 and thus the control the amount of dry surface area available for the vapor to release its latent heat of evaporation. That is to say, with the present invention, rather than adding a weight and cost increasing louvered radiator cover or the like apparatus to protect same from the cold and/or control the amount of air that may reach same, coolant which is essential and which must be carried with the engine is utilized and a few simple control valves and conduits (which shall be referred to as "valve and conduit means" hereinlater) which weigh very little are employed to manage the amount of coolant which is retained in the radiator in a manner to tailor the exchange capacity of same to approximately that required for the given set of conditions under which the engine is operated. Advantageously, from the point of accuracy, light weight and compactness the above mentioned microprocessor is used to operate the valves of the "valve and conduit means" in response to the various data inputs provided thereto.

In brief, when the engine is cold (viz., the temperature of the engine coolant is below 75° C.-by way of example) and the pressure within the system less than atmospheric, the control circuit provides fluid communication between the cooling circiut (viz., the coolant jacket, radiator conduiting through which coolant vapor is transferred to the radiator and a liquid coolant returning arrangement (conduit 132 and pump 136)) and the reservoir 146 and permits the cooling circuit to be completely filled with liquid coolant. This prevents the entry of contaminating atmospheric air. Upon engine start-up if the engine coolant temperature is below a given level the control circuit 180 energizes the coolant return pump 136 while simultaneously conditioning the "valve and conduit means" so that the pump 136 inducts coolant from the reservoir 146 and pumps same into the cooling circuit to overfill same and thus purge out any non-condensible matter which might have found its way into the system. Subsequently, as the coolant temperature rises to the point of producing vapor pressure, the latter is used to displace coolant from the system back out to the reservoir 146 until the coolant reaches the temperature at which the system should be operated is reached or the first and second level sensors 140 & 130 indicate that the amount of coolant in the cooling circuit has been reduced to a minimum allowable level appropriate predetermined levels. Upon either of these situations occuring, the control circuit 180 conditions the "valve and conduit means" to cut off fluid communication therethrough and place the cooling circuit in a "closed" state.

Depending on the inputs from the engine load and speed sensors 182 & 184, the control circuit 180 calculates (i) the temperature at which the engine should be operated, (ii) a first temperature control range with spans the target temperature and (iii) a second temperature control range which is wider than the first one. If the temperature deviates from the target value by an amount which falls within the first range, the control circuit 180 suitably energizes (or de-energizes) fan 127 to reduce the difference between the actual coolant temperature and the target value toward zero. However, if the coolant temperature is outside of the first range (viz., temperature control is beyond that possible with only the fan), the control circuit proceeds to condition the valve and conduit means in manner to vary the amount of the liquid coolant retained in the radiator 126 and thus vary the surface area via which heat can be released therefrom. For example, if the temperature of the coolant drops markedly below the target valve (viz., outside of first range) then the valve and conduit means is condition to introduce liquid coolant into the radiator 126 until the temperature of the coolant can be controlled only by the influence of the fan 127. On the other hand, should the temperature of the coolant markedly rise above the derived target level, then the valve and conduit means is condition to remove liquid coolant from the radiator 126 to increase the surface area via which the latent heat of evaporation of the coolant vapor can be released to the atmosphere.

Prior to initial use, the cooling system is completely filled with coolant (for example water or a mixture of water and antifreeze or the like) and the cap 164 securely set in place to seal the system. A suitable quantity of additional coolant is also placed in the reservoir 146. Although at this time, by using de-aerated water when initially filling the system and reservoir, the system is essentially free of contaminating air etc., over a period of time non-condensible matter will find its way into the cooling circuit. For example, the coolant (e.g. water) in the reservoir 146 will tend to absorb atmospheric air and each time the system is filled with coolant to as to obviate any negative pressures and exclude the entry of air, a little non-condensible matter will tend to find its way into the system. Further, during given modes of engine operation, slightly negative pressures develop and although the system is operating in a sealed or closed mode at the time, air, little by little, tends to leak into the system via the gasketing and the like defined between the cylinder head and cylinder block and between the seals defined between conduiting and associated elements of the system.

Accordingly, upon start-up of the engine, given that the engine temperature is blow a predetermined value (45° C. for example) the above mentioned a non-condensible matter purge operation is carried out. In this embodiment the purge operation is effected by pumping coolant into the system for a predetermined period of time and thus obviates the need for a level sensor for sensing the cooling system having assumed a completely foll condition. As the system is inevitably very close to full of coolant at this time, the excess coolant thus introduced positively displaces any air or the like the might have collected.

Figure 10:
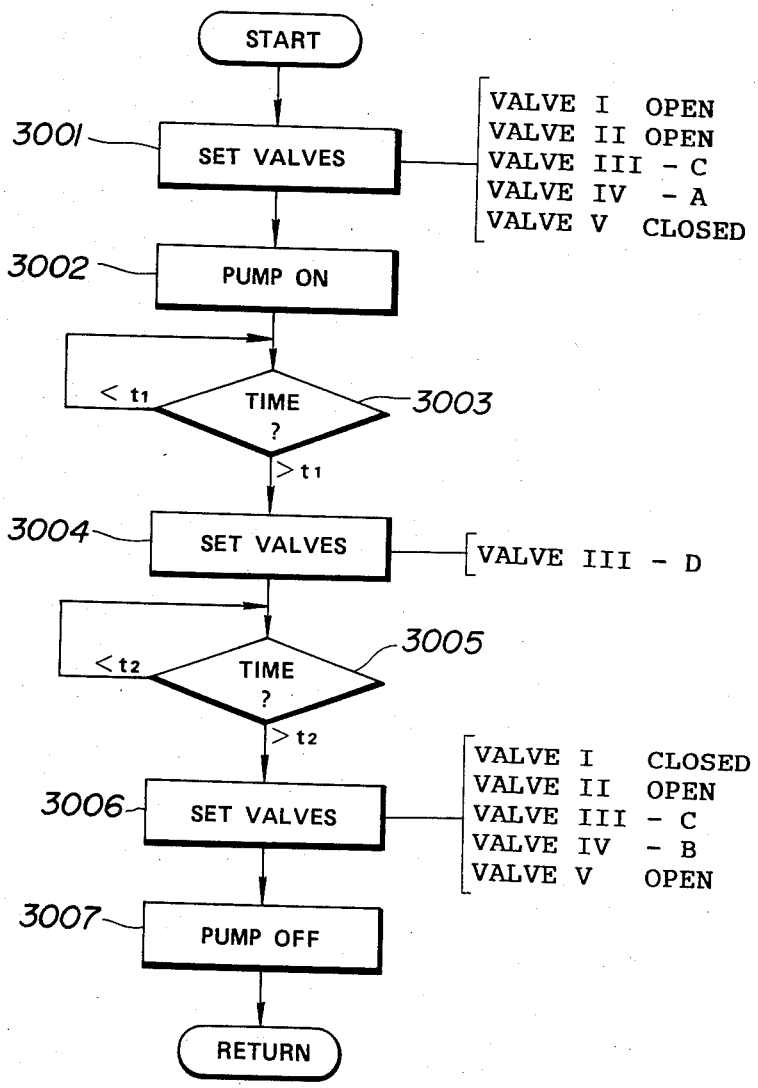

FIG. 10 shows the characterizing steps executed by the microprocessor (control circuit 180) during what shall be termed a "system control routine". As shown, subsequent to the start of this program, the system is initialized (step 1000). Following this it is determined in step 1001 whether the temperature of the engine coolant is greater than 45° C. If the outcome of this enquiry shows that the coolant is still cold (viz., below 45° C.) then the program proceeds to step 1002 wherein a "non-condensible matter purge routine" is effected. If the temperature of the coolant is above 45° C., then the engine is deemed to be "hot" and the program by-passes the purge routine and effects what shall be termed a "hot start". In the event that the purge routine is carried out, the system is considered as undergoing a "cold start".

At step 1003, the program enters a "coolant displacement/warm-up routine" wherein the coolant which fills the radiator and coolant jacket is displaced under the influence of the pressure which develops within the system when the coolant has been heated sufficiently. Upon the temperature of the coolant reaching a target value which is calculated in response engine speed and load data inputs, the program goes on to enter a normal "control routine" (step 1004).

Figure 11:
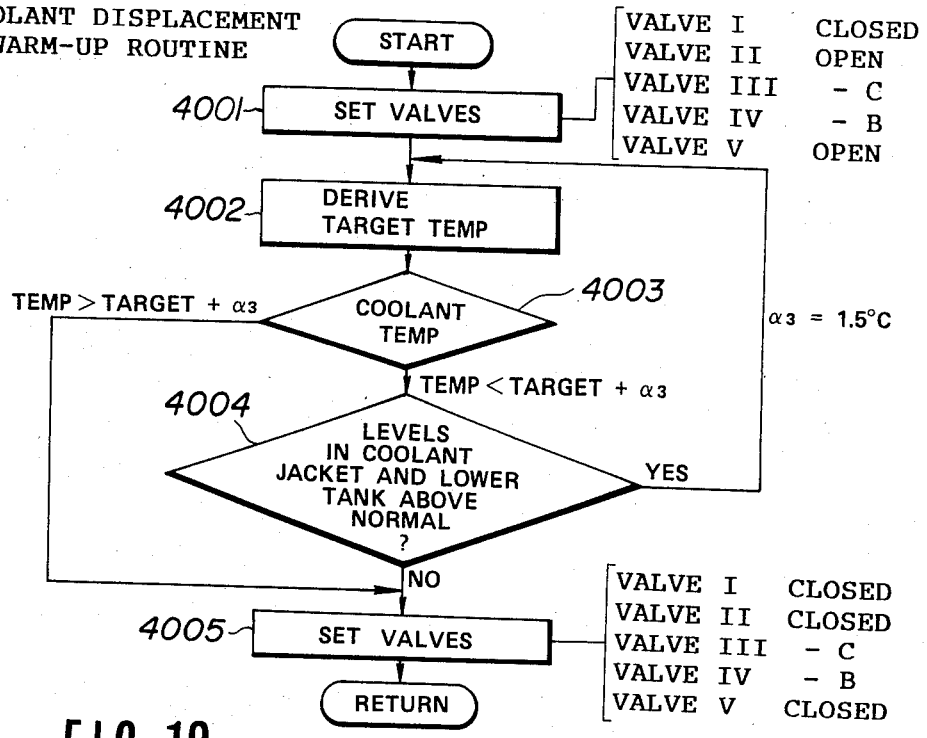

Upon the engine being stopped a "shut-down control routine" (see FIG. 11) is executed. This routine as shown, includes an interrupt (step 2001) which breaks into the program which is currently being run and proceeds to at step 2002 enter a routine which continues to control the system after the engine is stopped and the ignition switch is opened, until the system enters a state whereat switching from closed to open states is possible without violent discharges of coolant due to the presence of superatmospheric pressures within the cooling circuit.

Each of the above mentioned routines will now be set forth in more detail.

It should be noted that in the following description the valves of the "valve and conduit means" will be, for ease of explanation referred using the following classification wherein valves 170, 153, 154, 134 and 152 are additionally assigned numerals (I)-(V). Viz., are numbered in order of their height in the illustrated embodiment.

Non-condensible matter purge routine

Subsequent to the start of the non-condensible matter purge routine (step 3000) valves (I)-(V) are condition in step 3001—Viz., in a manner which opens valve 170 (I), opens valve 153 (II), conditions valve 154 (III) to establish flow path C, conditions valve 134 (IV) to establish flow path A and closes valve 152 (V).

At step 3002 pump 136 is energized and thus inducts coolant from reservoir 146 through conduit 149 and introduces same into the coolant jacket 120. A soft clock (step 3003) is arranged to maintain the just described condition for a predetermined time ($t_1$ seconds). This period may be selected in the order of several tens of seconds). At step 3004 valve 154 (III) is conditioned to establish flow path D. With this, the "valve and conduit arrangement" is arranged to introduce the coolant into the lower tank 128 via conduit 150. This switching is deemed advantageous as the time for which the pump is operated with the valve and conduit arrangement conditioned to introduced coolant directly into the coolant jacket should be sufficient to completely fill same and cause a little coolant to spill over via conduit 168 to the reservoir 146; and thus, upon the switching taking place, induce the situation wherein upon the coolant being pumped into the lower tank, any subborn remaining bubbles of air which might be still adhering to the inner walls of the condensor tubing are securely flushed out and displaced along with the excess coolant via conduit 168.

Upon a second soft clock (step 3005) indicating that a second predetermined time $t_2$ seconds (wherein $t_2$ is selected in the order of several tens of seconds) the valve are conditioned as shown in step 3006. This terminates the purge mode by closing valve (I) and further opens valve (V) in preparation for the subsequent coolant displacement mode.

Coolant displacement/Warm-up Mode

After the termination of the non-condensible matter purge mode the cooling circuit (coolant jacket 120 radiator 126 and associated conduiting) are completely filled with coolant. As the coolant according to the present invention is not forcefully circulated, the heat generated by the combustion processes in the combustion chambers of the engine is absorbed by the stagnant coolant and thus induces rapid warming of same. Upon entry into the coolant displacement/warm-up mode valve (I)-(V) are conditioned as shown in step 4001 of FIG. 11. Under these conditions as vapor pressure within the system develops due to the heating of the coolant in the cooling circuit, liquid coolant is displaced out of the system to the reservoir 146.

At step 4002 the "target" temperature at which the the coolant should be caused to boil is derived in response to the various data inputs. In this embodiment the inputs take the form of engine speed and engine load. The target temperature is selected mathermatically derived or alternatively obtained using prestored data (for example a look-up table of the nature of that shown in FIG. 6). At step 4003 the coolant temperature is sampled. In the event that the coolant temperature is less than the derived target value +a3 then the program flows to step 4004 wherein the outputs of the level of the level sensors 140 and 132 are sampled and it ascertained if the level of coolant in both the coolant jacket 120 and the lower tank 128 are above the normally required levels. If the outcome of this enquiry indicates that the levels are in fact both above normal, the program recycles to step 4002.

In the event that the coolant temperature sampled in step 4003 is determined to be greater than the target value +a3 then the program by-passes the level enquiry and goes directly to setp 4005 wherein valves (I) to (V) are set as shown. That is to say, the cooling circuit is placed in a hermetically closed condition. Thus, as will be appreciated, step 4004 allows for displacement under the increasing vapor pressure in the coolant jacket and terminates the displacement when either the desired target temperature is reached or the maximum possible amount of coolant has been displaced from the system.

Normal control routine

FIGS. 12 to 15 show in flow chart form the steps which characterize the operation of the "normal operation mode".

Figure 12:
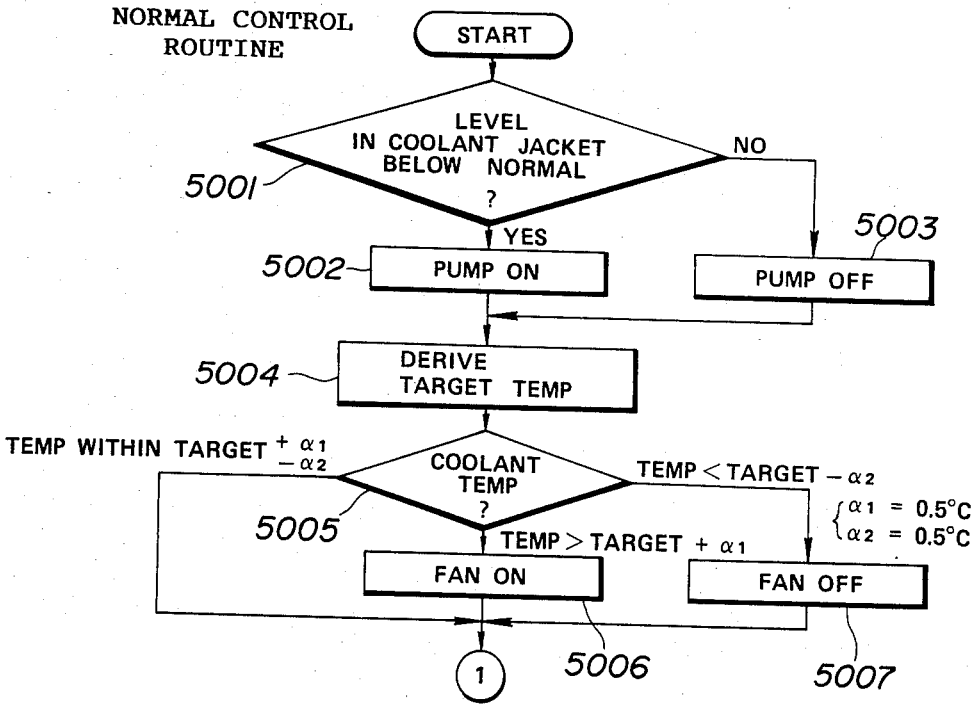

As shown in FIG. 12 subsequent to the start of this control, the output of level sensor 140 is sampled (step 5001) in a manner to determine if the level of coolant in the coolant jacket 120 is lower than same. If the outcome is positive, viz., the level of coolant in the coolant jacket 120 is below that of the level sensor 140, then pump 136 is energized (step 5002). However, if the coolant level is at or above that of the level sensor 140 then the program flows to step 5003 wherein the operation of the pump 136 is stopped.

At step 5004 the target temperature at which the coolant should be caused to boil for the instant set of operating conditions is derived. At step 5005 the output of the coolant temperature sensor 144 is sampled. The temperature is then ranged (determined to be within a first predetermined range of the target value) as shown. In the event that the sampled temperature is within a range of the derived target $$+a1$$
$$-a2$$

then the program by-passes steps 5006 and 5007. However, in the event that the sampled temperature is greater than the target value +a1 fan 127 is energized. On the other hand, if the temperature is less than the target value −a2 the operation of the fan is stopped.

Subsequently, at step 5008 the coolant temperature is again sampled. In the event that coolant temperature is within a second predetermined range of target $$+a3$$
$$-a4$$

then the program returns. However, in the case that the sampled temperature is determined to be less than target −a4 the program flows to step 5018 (FIG. 14); while in the event the temperature is greater than the desired target value by a value a3 the program flows to step 5009 wherein the output of the level sensor 130 in the lower tank 128 is sampled and it determined if the coolant level is higher than same. If the level is at or lower than the sensor, then the program flows to step 5017 as shown, while in the event that the level is above same, then at step 5010 valves (I) to (V) are conditioned as shown and pump 136 energized. The system is accordingly conditioned to pump coolant out of the lower tank 128 and discharge same into the reservoir 146. This of course reduces the amount of coolant contained in the radiator 126 and thus increases the surface area available for the latent heat of evaporation and thus enables the reduction of the elevated temperature.

At step 5012 the coolant level in the coolant jacket is monitored. In the event that the level in the coolant jacket is above normal, viz., above level sensor 140 then the program flows to setp 5013 wherein valve (III) is conditioned to establish flow path D. On the other hand, if the level of coolant in the coolant jacket is lower than level sensor 140 then at step 5014 flow path C is established.

As will be appreciated, in the event that excess coolant is still contained in the coolant jacket (viz., the level therein is above level sensor 140) then it is still possible to continue to withdraw coolant from the lower tank 128. However, if the level of coolant has reached level sensor 140 then further pumping of coolant out to reservoir 146 should be terminated and accordingly, valve (III) is condition to establish flow path C.

At step 5015 the output of level sensor 130 is sampled and the level of coolant in the lower tank 128 again determined. In the event that the level is above that of level sensor 130 then it is still possible to withdraw liquid coolant from the coolant circuit and pump same out to the reservoir 146. Accordingly, the program recycles to step 5009. On the other hand, if the level of coolant in the lower tank 128 is at or lower than level sensor 130 then the program flows to step 5016 wherein the target temperature is derived. At step 5017 the coolant temperature is sampled. In the event that this enquiry reveals that the coolant temperature is lower than target +a5 the program recycles to step 5012. However, if the coolant temperature is greater than target +a5 then at step 5018 valves (I) to (V) are conditioned as shown and the program returns.

Figure 13:
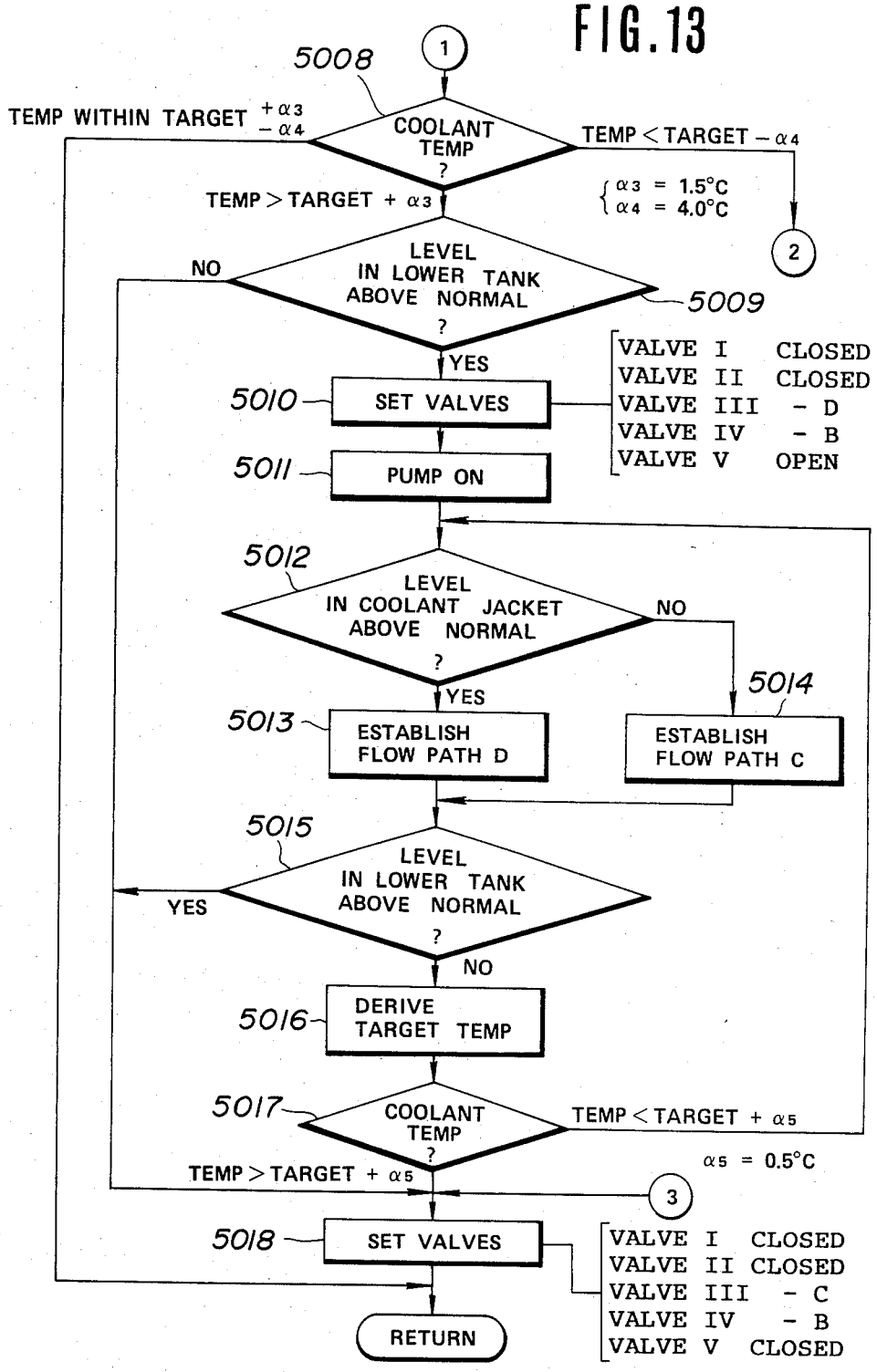
Figure 14:
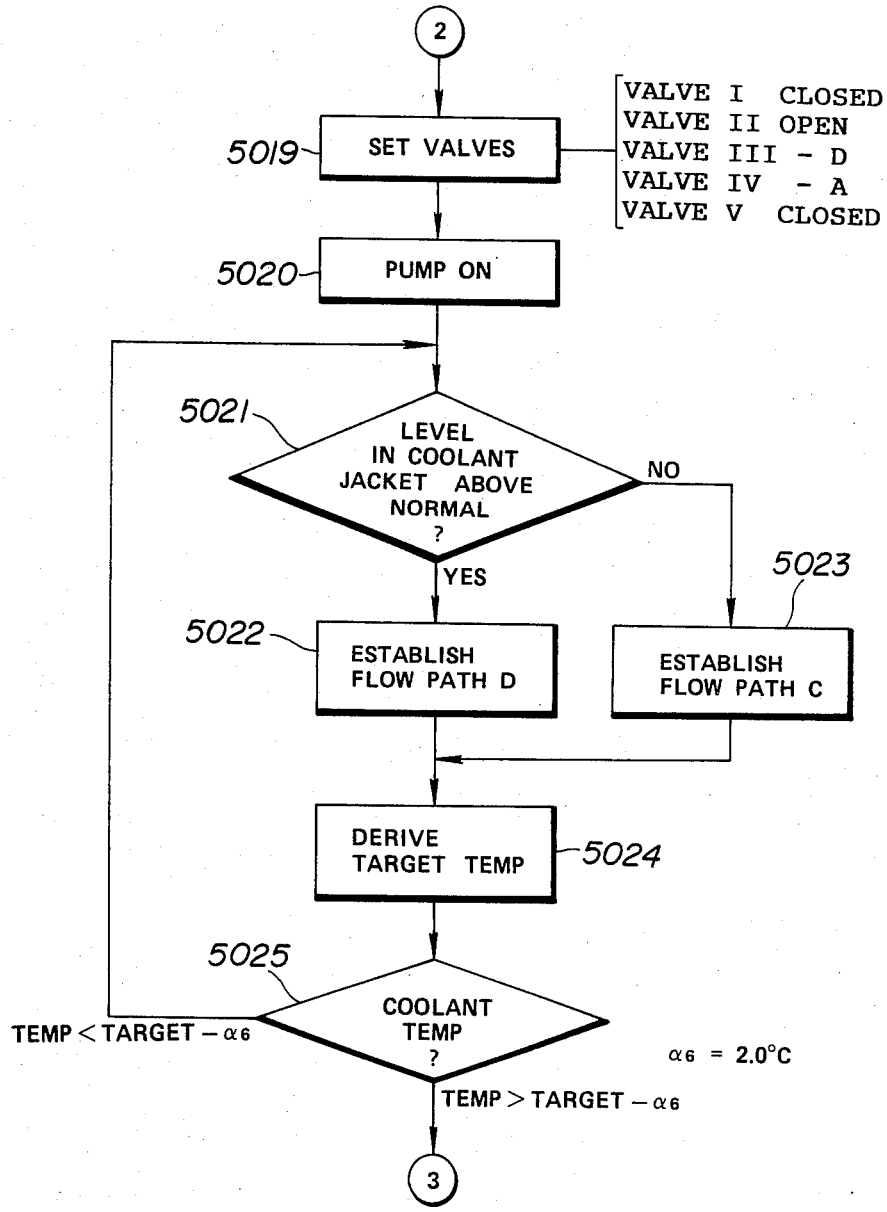

FIG. 14 shows the steps which follow on from step 5008 of FIG. 13. As shown, in step 5019 valves (I) to (V) are set in a manner as indicated and pump 136 energized (step 5020). This of course conditions the system to induct coolant from the reservoir 146 and pump same into the lower tank 128 and thus increase the level of coolant in the radiator 126 and reduce the amount of heat which can be released thereby and thus exact a measure which will tend to raise the undesirably low temperature (viz., the temperature which is lower than target −a4).

A step 5021 the level of coolant in the coolant jacket is sampled. In the event that the level is above that of level sensor 140 valve (III) is conditioned to establish flow path D while in the reverse case flow path C is established. Subsequently, at stop 5024 the target temperature is derived and at step 5025 the actual temperature compared with that just derived. In the Event that the temp is less than target −a6 then the program recycles to step 5021. Conversely, if the temperature is found to be greater than target −a6 then the program flows to step 5018 (FIG. 13).

Thus, as will be appreciated from the above description when the temperature deviates from the mathematically derived target value by 0.5° C. then the temperature is controlled utilizing the change in heat exchange which can be achieved by fan energization/de-energization. However, in the event that the temperature increases above the target value by 1.5° C. or drops by 4.0° C. then the amount of coolant retained in the radiator is varied. Of course the above quoted figures are merely examples and may be varied with the magnitude of the target temperature.

Figure 9:
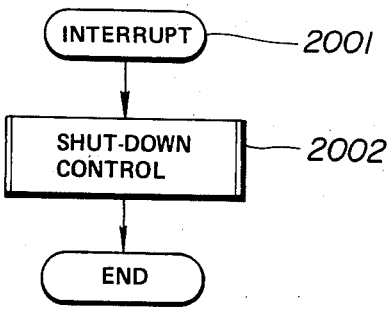
Figure 15:
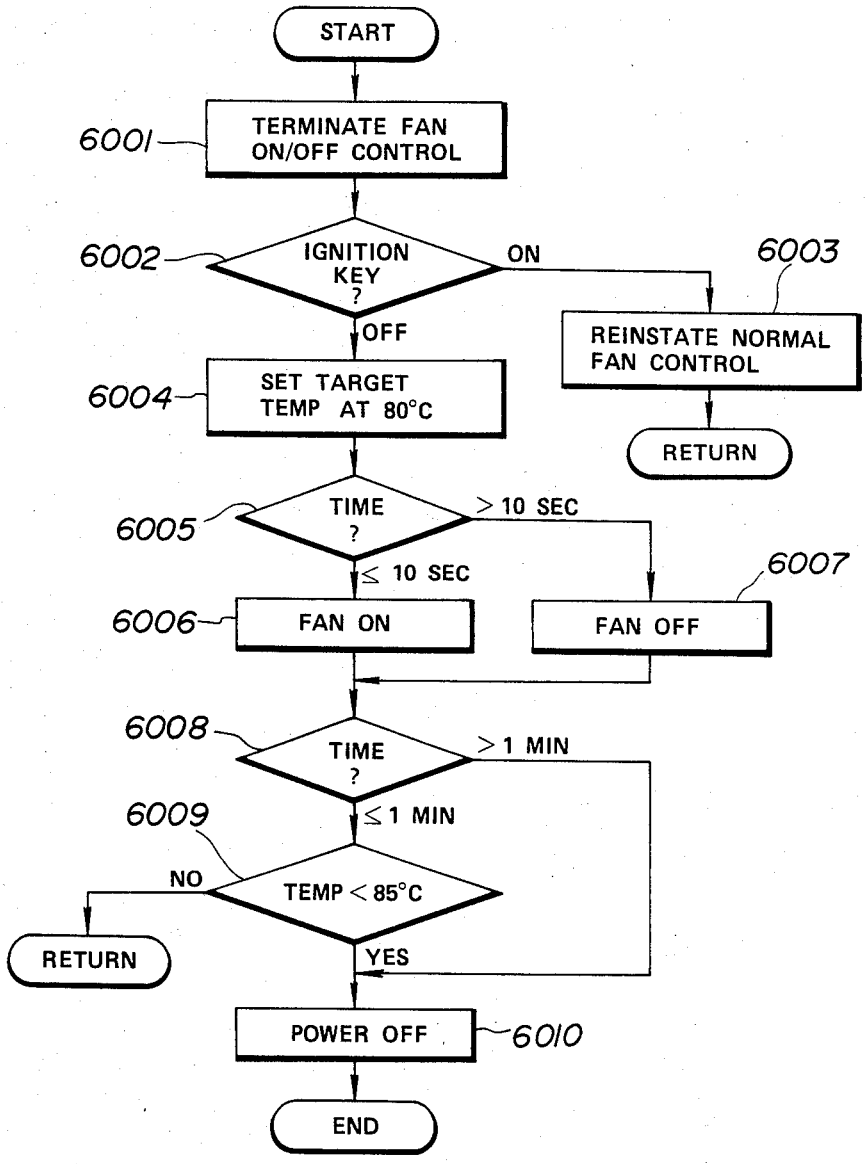

FIG. 15 shows in detail the shut-down routine of FIG. 9. As show, after the interrupt which breaks into the currently run control program, the normal ON/-OFF control of fan 127 is terminated at step 6001 and at step 6002 the enquiry made as to status of the ignition key. This step is provied to determine if the engine has been deliberately stopped or has merely stalled and will be immediately restarted. In the event that the ignition key is still on, the program flows step 6003 wherein normal fan control is reinstated. However, in the event that the engine has been purposely stopped then the program goes to step 6004 wherein a target temperature suited to the shut-down operation is readout of ROM. At step 6005 a soft timer induces continuous fan operation for a predetermined period of time. In this instance 10 seconds. Subsequent to the expiry of this time, a second soft timer is set counting and at step 6010 the coolant temperature sampled. In the event that coolant temperature is still above the value set in step 6004 then the program returns. However, in the event that the second timer indicates the expiry of the second predetermined period and the temperature of the coolant is below 85° C. (by way of example) then the power to the entire system is teminates in step 6011. This of course permits valve (V) 152 to open (due toits de-energization) and thus allow the coolant stored in the reservoir 146 to be inducted into the cooling circuit under the influence of the negative pressure which prevails therein. As will be appreciated, as the coolant vapor condenses, the volume occupied thereby will be replaced with liquid coolant and the cooling circuit completely filled with coolant.

If the engine is restarted while the coolant temperature is between 85° C. and 45° C. then the non-condensible matter purge mode will be by-passed and the coolant displaement/warm-up mode directly entered.

Figure 16:
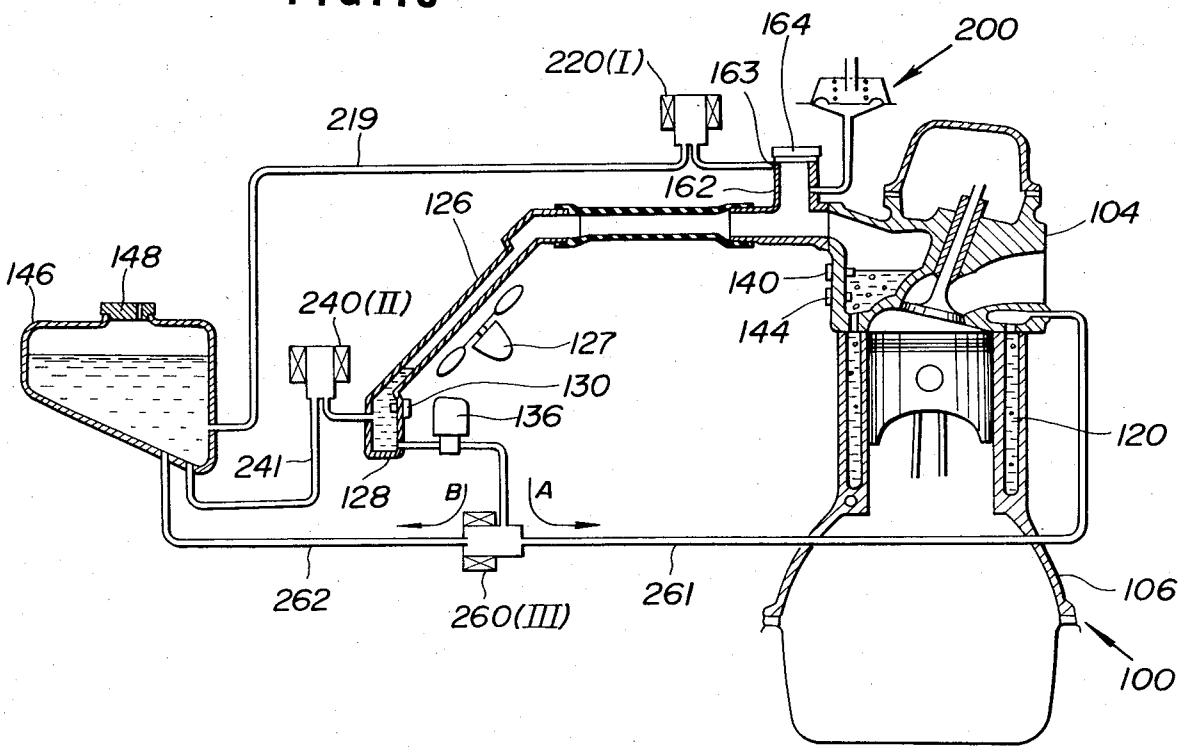
FIG. 16 shows a second embodiment of the present invention.

FIG. 16 shows a second embodiment of the present invention. This embodiment features a simplified valve and conduit arrangement and the incorporation of a pressure sensitive device 200 which is responsive to the pressure differential existing between the interior of the cooling circuit and the ambient atmosphere.

More specifically, the valve and conduit arrangement of this embodiment includes an ON/OFF type purge control valve 220 (I) which controls fluid communication between the purge port 163 and the reservoir 146 via overflow conduit 221, a second ON/OFF type valve 240 (II) which controls fluid communication between the lower tank 128 and the reservoir 146 via conduit 241 and a three-way valve 260 (III) which is arranged to establish fluid communication between the pump 136 and the coolant jacket 120 (viz., flow path A) via conduit 261 when in a first state and establish fluid communication between the pump and the reservoir 146 (flow path B) via conduit 262 when in a second state.

With this arrangement by suitably arranging the pressure responsive device 200 it is possible to de-energize valve 240 (II) in response to an excessively low pressure and permit coolant to be inducted into lower tank and radiator under the influence of the sub-atmospheric pressure and to condition valve 260 (III) to establish flow path B in response to a coolant temperature which is higher than desired, and thus permit the pump to positively displace coolant from the lower tank in manner to increase the surface area available for heat exchange. As will be appreciated the above arrangement is suited for use wherein the boiling point of the engine coolant is within a range of 80° to 100° C. (viz., the pressure in the system is normally equal to or lower than one atmosphere.

However, if pump 136 is arranged to be reversible, then it is possible to positively introduce coolant into the cooling circuit even when the pressure prevailing therein is above atmospheric by establishing flow path B and reversing the normal rotational direction of the pump motor.

Of course it is within the purview of the present invention to incorporate a pressure differential responsive device of the nature of #200 disclosed hereinabove into the first embodiment if so desired.

It should be noted that with the present invention the inevitably delay in temperature control induced by the relatively slow filling and emptying process involved in varying the effective surface area of the radiator, the combination with this control with that provided by the fan 127 obviates any notable sluggish response and the temperature of the coolant is quickly moved to and subsequently stably held within desirable limits of the temperature best suited for the instant mode of operation of the engine to which the invention is applied.

What is claimed is:

1. In an internal combustion engine:

a structure subject to high heat flux; and a cooling system comprising:

a cooling circuit which includes:

(a) a coolant jacket formed about said structure subject to high heat flux and into which coolant is introduced in liquid form, permitted to boil and discharged in gaseous form, (b) a radiator exposed to a cooling medium which can remove heat from said radiator, (c) a vapor transfer conduit leading from said coolant jacket to said radiator for transfering gaseous coolant from said coolant jacket to said radiator for condensation therein, and (d) means for returning coolant condensed to its liquid state in said radiator to said coolant jacket in a manner to maintain said structure immersed in a predetermined depth of coolant;

a first sensor for sensing a parameter which varies with the temperature of the coolant in said coolant jacket;

a second sensor for sensing a parameter which varies with load on said engine;

a reservoir containing liquid coolant;

valve and conduit means for controlling fluid communication between said reservoir and said cooling circuit;

a device for increasing the rate of heat exchange between the cooling medium and said radiator; and a control circuit responsive to the outputs of said first and second sensors, said control circuit including means for:

(a) controlling said valve and conduit means in a manner to control the amount of liquid coolant in said radiator and therefore the amount of surface area via which the latent heat of evaporation of said coolant vapour can be released, and (b) controlling said device in a manner to vary the rate of heat exchange between said radiator and the cooling medium.

2. An internal combustion engine as claimed in claim 1, wherein said coolant returning means takes the form of:

a first conduit leading from said radiator to said coolant jacket;

a pump disposed in said first conduit; and a first level sensor disposed in said coolant jacket, said first level sensor being arranged to control said pump in a manner to maintain said structure immersed in said predermined depth of coolant.

3. An internal combustion engine as claimed in claim 2, wherein said valve and conduit means comprises:

a first electromagnetic valve disposed in said first conduit at a location between said radiator and said pump; and a second conduit leading from said reservoir to said first valve, said first electromagnetic valve having a first state wherein it permits fluid communication between said radiator and said coolant jacket and a second state wherein it interrupts fluid communication between said radiator and said coolant jacket and establishes fluid communication between said second conduit and said coolant jacket;

a second electromagnetic valve disposed in said first conduit at a location between said pump and said coolant jacket;

a third conduit leading from said radiator to said second valve, said second electromagnetic valve having a first state wherein it establishes communication between said pump and said coolant jacket and a second state wherein it interrupts the communication between said pump and said coolant jacket and establishes communication between said coolant jacket with said radiator through said third conduit;

a third electromagnetic valve disposed in said third conduit;

a fourth conduit leading from said reservoir to said third conduit, said fourth conduit communicating with said third conduit at a location between said second and third valves;

a fourth electromagnetic valve disposed in said fourth conduit, said fourth electromagnetic valve having a first state wherein it establishes communication between said reservoir and said third conduit and a second state wherein the communication between said reservoir and said third conduit is interrupted;

a fifth conduit leading from the top of said cooling circuit to said reservoir; and a fifth electromagnetic valve disposed in said fifth conduit, said fifth electromagnetic valve having a first state wherein communication between said reservoir and said cooling circuit is interrupted and a second state wherein communication between said cooling circuit and said reservoir is established.

4. An internal combustion engine as claimed in claim 2, wherein said valve and conduit means takes the form of:

a first electromagnetic valve disposed in said first conduit at a location between said pump and said coolant jacket;

a second conduit leading from said reservoir to said first valve, said first electromagnetic valve having a first state wherein communication between said pump and said coolant jacket is permitted and a second state wherein the communication between said pump and said coolant jacket is interrupted and communication between said pump and said reservoir established;

a third conduit leading from said radiator to said reservoir;

a second electromagnetic valve disposed in said third conduit, said second electromagnetic valve having a first state wherein communication between said reservoir and said coolant jacket is interrupted and a second state wherein communication between said reservoir and said radiator is permitted;

a fourth conduit leading from the top of said cooling circuit to said reservoir; and a third electromagnetic valve disposed in said fourth conduit, said third electromagnetic valve having a first state wherein communication between said cooling circuit and said reservoir is interrupted and a second state wherein communication between said cooling circuit and said reservoir is established.

5. An internal combustion engine as claimed in claim 1, further comprising:

a pressure differential responsive device, said device being arranged to produce a signal when the pressure differential between the interior of said cooling circuit and the ambient atmosphere surrounding said engine.

6. An internal combustion engine as claimed in claim 1, wherein said control circuit further includes means for:

(c) controlling said valve and conduit means in a manner that when the temperature within said cooling circuit is below a predetermined level and the engine is stopped, communication between said reservoir and said cooling circuit is established in a manner that coolant from said reservoir flows into said cooling circuit and completely fills same.

7. An internal combustion engine as claimed in claim 6, wherein said control circuit is further arranged to condition said valve and conduit means and said coolant return means in a manner to pump excess coolant from said reservoir into said cooling circuit until excess coolant overflows back to said reservoir, when the engine is started and the temperature of the coolant in said cooling circuit is below a predetermined level.

8. An internal combustion engine as claimed in claim 1, wherein said control circuit is arranged to:

(i) determine, in response to the input from said second sensor, a target temperature at which the coolant in said cooling circuit should be maintained;

(ii) a first temperature range which spans said target temperature; and (iii) a second temperature range which spans said target temperature and said first temperature range, said control circuit being arranged to control said device in a manner to maintain said target temperature while the temperature of said coolant is within said first range and control the amount of coolant in said radiator when the coolant temperature moves out of said first range into said second one.

9. A method of controlling an internal combustion engine comprising the steps of:

introducing liquid coolant into a coolant jacket formed about structure of said engine subject to high heat flux;

permitting the coolant to boil;

condensing the gasesous coolant to its liquid form in a radiator exposed to a cooling medium;

sensing a first parameter which varies with the temperature of the coolant in said coolant jacket;

sensing a second parameter which varies with load on the engine;

storing liquid coolant in a reservoir;

controlling communication between said reservoir and said coolant jacket using valve and conduit means controlling said valve and conduit means in a manner to:

(i) control the amount of liquid coolant in said radiator and thus the surface area thereof via which the latent heat of evaporation of said coolant can be release to the cooling medium;

(ii) controlling a device associated with said radiator in a manner to vary the heat exchange between said radiator and the cooling medium.

10. A method as claimed in claim 9, further comprising the steps of:

calculating in response to the magnitude of said second parameter:

(i) a target temperature to which the coolant in said coolant jacket should be controlled;

(ii) a first temperature range which spans said target temperature;

(iii) a second temperature range which spans both of said target temperature and said first temperature range;

controlling said device in a manner to vary the heat exchange between said radiator and the cooling medium while the temperature of the coolant is within said first range; and controlling the amount of coolant in said radiator when the temperature of said coolant moves out of said first ranged into the second one.

11. A method as claimed in claim 9, further comprising the steps of:

sensing the pressure differential between the interior of said cooling circuit and the ambient atmosphere; and controlling said valve and conduit means in response to the pressure differential in a manner that sudden discharges of coolant from said cooling circuit to said reservoir due to superatmospheric pressures in said cooling circuit are obviated.

* * * * *